US009917378B2

(12) United States Patent
Yamada

(10) Patent No.: US 9,917,378 B2
(45) Date of Patent: Mar. 13, 2018

(54) TERMINAL ATTACHING/DETACHING DEVICE

(71) Applicant: HIROSE ELECTRIC CO., LTD., Tokyo (JP)

(72) Inventor: Yoshihisa Yamada, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 15/382,978

(22) Filed: Dec. 19, 2016

(65) Prior Publication Data

US 2017/0187129 A1 Jun. 29, 2017

(30) Foreign Application Priority Data

Dec. 24, 2015 (JP) ..... 2015-251950

(51) Int. Cl.

| | |
|---|---|
| ***H01R 9/22*** | (2006.01) |
| ***H01R 4/50*** | (2006.01) |
| ***H01R 11/03*** | (2006.01) |
| ***H01R 11/12*** | (2006.01) |
| ***H01R 4/30*** | (2006.01) |
| ***H01R 4/36*** | (2006.01) |
| ***H01R 4/48*** | (2006.01) |
| ***H01R 13/639*** | (2006.01) |
| *H01R 9/26* | (2006.01) |

(52) U.S. Cl.

CPC ..... *H01R 4/50* (2013.01); *H01R 4/301* (2013.01); *H01R 4/305* (2013.01); *H01R 4/307* (2013.01); *H01R 4/36* (2013.01); *H01R 4/4872* (2013.01); *H01R 11/03* (2013.01); *H01R 11/12* (2013.01); *H01R 13/639* (2013.01); *H01R 9/26* (2013.01)

(58) Field of Classification Search

CPC ..... H01R 9/24; H01R 31/02; H01R 4/363; H01R 4/4872

USPC ..... 439/709, 712, 811, 812, 817

See application file for complete search history.

(56) References Cited

U.S. PATENT DOCUMENTS

| | | | | |
|---|---|---|---|---|
| 6,338,649 | B1 | 1/2002 | Smith | |
| 8,308,516 | B2 * | 11/2012 | Gassaur | H01R 4/4872 439/817 |
| 8,668,513 | B2 * | 3/2014 | Pickard | F21V 17/10 439/333 |

FOREIGN PATENT DOCUMENTS

| | | | |
|---|---|---|---|
| GB | 2502776 | A | 12/2013 |
| JP | S5371787 | U | 6/1978 |
| JP | S53160783 | U | 12/1978 |
| JP | H04-370670 | A | 12/1992 |
| JP | H09-161868 | A | 6/1997 |

(Continued)

*Primary Examiner* — Phuong Chi T Nguyen

(74) *Attorney, Agent, or Firm* — Kubotera & Associates, LLC

(57) ABSTRACT

A terminal attaching/detaching device includes a housing, an engaging member, and a movable member. The engaging member is configured to move in a first direction toward a terminal inserted in the housing to engage with the terminal, and is configured to move from the terminal inserted in the housing in a second direction to disengage from the terminal. The movable member is configured to move in concert with the engaging member in the moving process thereof in the first direction, and is configured to move the engaging member from the terminal inserted in the housing in the second direction, so that the engaging member is disengaged from the terminal.

12 Claims, 17 Drawing Sheets

(56) References Cited

FOREIGN PATENT DOCUMENTS

| | | | |
|---|---|---|---|
| JP | 2005149757 | A | 6/2005 |
| WO | 0169726 | A1 | 9/2001 |

* cited by examiner

TERMINAL ATTACHING/DETACHING DEVICE

BACKGROUND OF THE INVENTION AND RELATED ART STATEMENT

The present invention relates to a terminal attaching/detaching device.

Patent Reference has disclosed a conventional terminal attaching/detaching device. The conventional terminal attaching/detaching device is used to attach/detach, for example, a terminal onto/from an electric switchboard, a machining apparatus, and a computer product. According to Patent Reference, the conventional terminal attaching/detaching device is equipped with a terminal relay function. The conventional terminal attaching/detaching device is capable of attaching and detaching a terminal through simple one action without using a screw.

Patent Reference: Japanese Patent Application Publication No. 09-161868

FIG. 23 shows an example of a configuration of the conventional terminal attaching/detaching device disclosed in Patent Reference. In the conventional terminal attaching/detaching device, in order to connect terminals 117 to each other, first, it is necessary to pull a finger grip 111 against an urging force of a coil spring 115. While being in this state, each of the terminals 117 is inserted between a pressing plate 114 of a base 107 and a connecting metal fitting 108, and the finger grip 111 is released. As a result, the urging force of the coil spring is released, so that a rod 112 is moved down. Then, the terminal 117 becomes pinched between the pressing plate 114 and the connecting metal fitting 108 while a protrusion 122 is being inserted in a hole 118. In this case, since the rod 112 is inserted in the hole 118, it is not possible to pull out the terminal 117. On the other hand, in order to remove each of the terminals 117, it is necessary to remove the rod 112 inserted in the hole 118 while the finger grip 111 is being lifted against the urging force of the coil spring 115.

As described above, in the conventional terminal attaching/detaching device, it is necessary to lift each of the finger grips 111 to pull out the terminals 117. Furthermore, since it is always necessary to operate the finger grips 111, it is difficult to flexibly apply the conventional terminal attaching/detaching device to various use situations. Therefore, there has been a demand for solving the problems.

In view of the problems described above, an object of the present invention is to provide a terminal attaching/detaching device, whereby it is achievable to flexibly apply the device in various use situations.

Further objects and advantages of the present invention will be apparent from the following description of the present invention.

SUMMARY OF THE PRESENT INVENTION

In order to attain the objects described above, according to a first aspect of the present invention, a terminal attaching/detaching device includes a housing, an engaging member, and a movable member. The engaging member is configured to move in a first direction toward a terminal inserted in the housing to engage with the terminal, and is configured to move from the terminal inserted in the housing in a second direction to disengage from the terminal. The movable member is configured to move in concert with the engaging member in the moving process thereof in the first direction, and is configured to move the engaging member from the terminal inserted in the housing in the second direction, so that the engaging member is disengaged from the terminal.

According to the first aspect of the present invention, the movable member is configured to move so that the engaging member is released from the engagement between the engaging member and the terminal in a direction different from the direction that the engaging member is configured to move from the terminal the engaging member is released from the engagement between the engaging member and the terminal. Therefore, it is achievable to release the engagement between the engaging member and the terminal through moving the movable member, instead of moving the engaging member itself from the terminal. As a result, it is achievable to flexibly apply the terminal attaching/detaching device in various use situations.

According to a second aspect of the present invention, in the terminal attaching/detaching device, the movable member can be the one that moves the engaging member in the first direction in concert with the engaging member in the process of moving the engaging member in the second direction.

According to the second aspect of the present invention, it is achievable to operate the engaging member through moving the movable member, instead of moving the engaging member itself. Therefore, it is further easier to flexibly apply the terminal attaching/detaching device in various use situations.

According to a third aspect of the present invention, in the terminal attaching/detaching device, the first direction and the second direction may be completely opposite to each other.

According to the third aspect of the present invention, when the first direction and the second direction are set opposite to each other, it is achievable to simplify the configuration.

According to a fourth aspect of the present invention, the movable member and the engaging member may be aligned to each other in their moving directions.

According to the fourth aspect of the present invention, it is achievable to reduce the space to dispose the movable member and the engagement member.

According to a fifth configuration of the present invention, in the terminal attaching/detaching device, either the movable member or the engaging member may include a first sloped portion that is sloped in a direction having an acute angle from the moving direction of the movable member. Corresponding to this, the other member, i.e., the engaging member or the movable member may include a first engaging portion that can engage with the first sloped portion in the process of moving the movable member.

According to the fifth configuration of the present invention, when the movable member moves relative to the engaging member, it is achievable to rotate the engaging member relative to the movable member in a certain direction through engagement between the first sloped portion and the first engaging portion.

According to a sixth aspect of the present invention, in the terminal attaching/detaching device, either the housing or the engaging member may include a second sloped portion that is sloped in a direction having an acute angle from the moving direction of the movable member.

Corresponding to this, the other member, i.e., the engaging member or the housing, may include a second engaging portion that can engage with the second sloped portion in the process of moving the movable member.

According to the sixth aspect of the present invention, upon moving the movable member relative to the engaging member in the first direction to rotate the engaging member in a third direction relative to the movable member, it is achievable to move the engaging member relative to the movable member in the second direction through the engagement between the second sloped portion and the second engaging portion. On the other hand, upon moving the movable member relative to the engaging member in the second direction to rotate the engaging member relative to the movable member in the fourth direction, it is achievable to move the engaging member relative to the movable member in the first direction through the engagement between the second sloped portion and the second engaging portion. As a result, through operation of the movable member, it is achievable to engage between the engaging member and the terminal or to release the engagement between the engaging member and the terminal.

According to a seventh aspect of the present invention, in the terminal attaching/detaching device, it may be achievable to visually check the behavior of the engaging member.

According to the seventh aspect of the present invention, when it is achievable to visually check the behavior of the engaging member, it is easy to see the engaged state of the engaging member and the terminal.

According to an eighth aspect of the present invention, at least a part of the engaging member may be accommodated in the movable member, and the movable member may have a window so as to be able to see at least a part of behavior of the engaging member accommodated in the movable member.

According to the eighth aspect of the present invention, it is achievable to visually check the behavior of the engaging member through the window of the movable member. In addition, it is also achievable to easily see the engagement state of the engaging member and the terminal.

Therefore, for example, it is achievable to effectively prevent incomplete fitting.

According to a ninth aspect of the present invention, in the terminal attaching/detaching device, the terminal may be inserted in the housing along a direction perpendicular to the moving direction of the movable member.

According to the ninth aspect of the present invention, when the insertion direction of the terminal and the moving direction of the movable member are perpendicular to each other, it is achievable to simplify the device configuration.

According to a tenth aspect of the present invention, inside the terminal attaching/detaching device, there may be provided an electrical connection mechanism, so that the terminal attachment/detachment can have a terminal relay function to electrically relay at least two terminals attached to the terminal attaching/detaching device through the electrical connection mechanism.

According to the present invention, it is achievable to provide a terminal attaching/detaching device that may be flexibly applicable in various use situations.

DETAILED DESCRIPTION OF THE PREFERRED EMBODIMENTS

Hereunder, an embodiment of the present invention will be described with reference to the accompanying drawings. In the description below, an example of applying the present invention in a device equipped with a terminal relay function, i.e., a function that can electrically relay at least two terminals. It should be noted that the embodiment is just an example of how to apply the present invention, and is not intended to limit the scope of the present invention to a terminal attaching/detaching device equipped with a terminal relay function.

Figure 1:
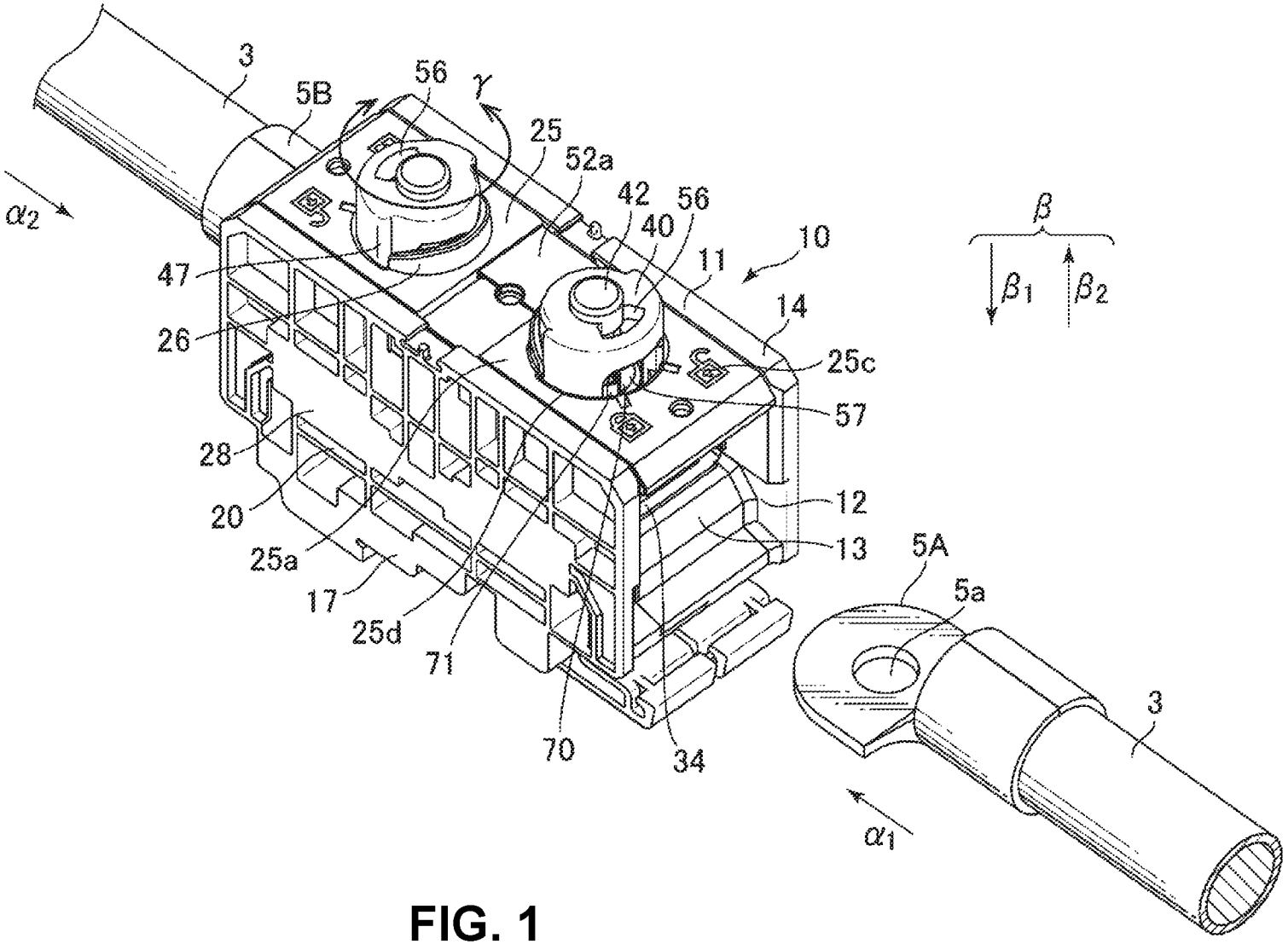
FIG. 1 is a perspective view showing an embodiment of use of a terminal attaching/detaching device according to an embodiment of the present invention.
Figure 2:
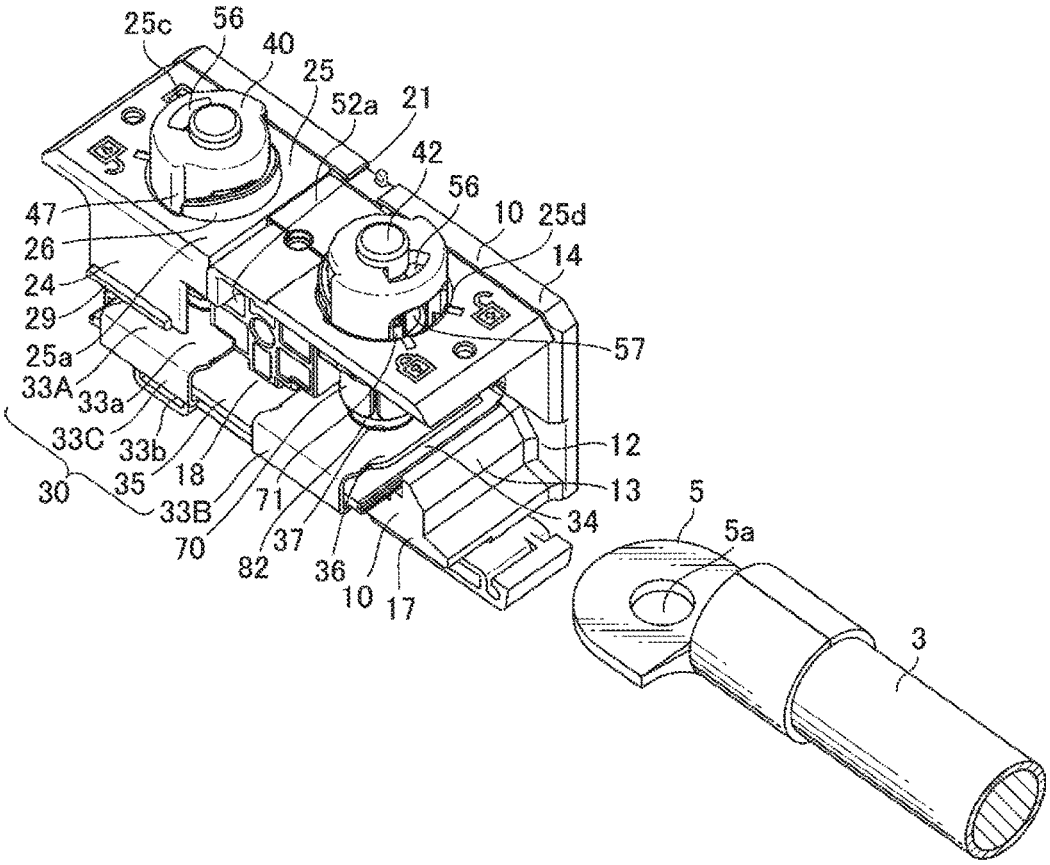
FIG. 2 is a perspective view showing an inside configuration of the terminal attaching/detaching device according to the embodiment of the present invention.
Figure 3:
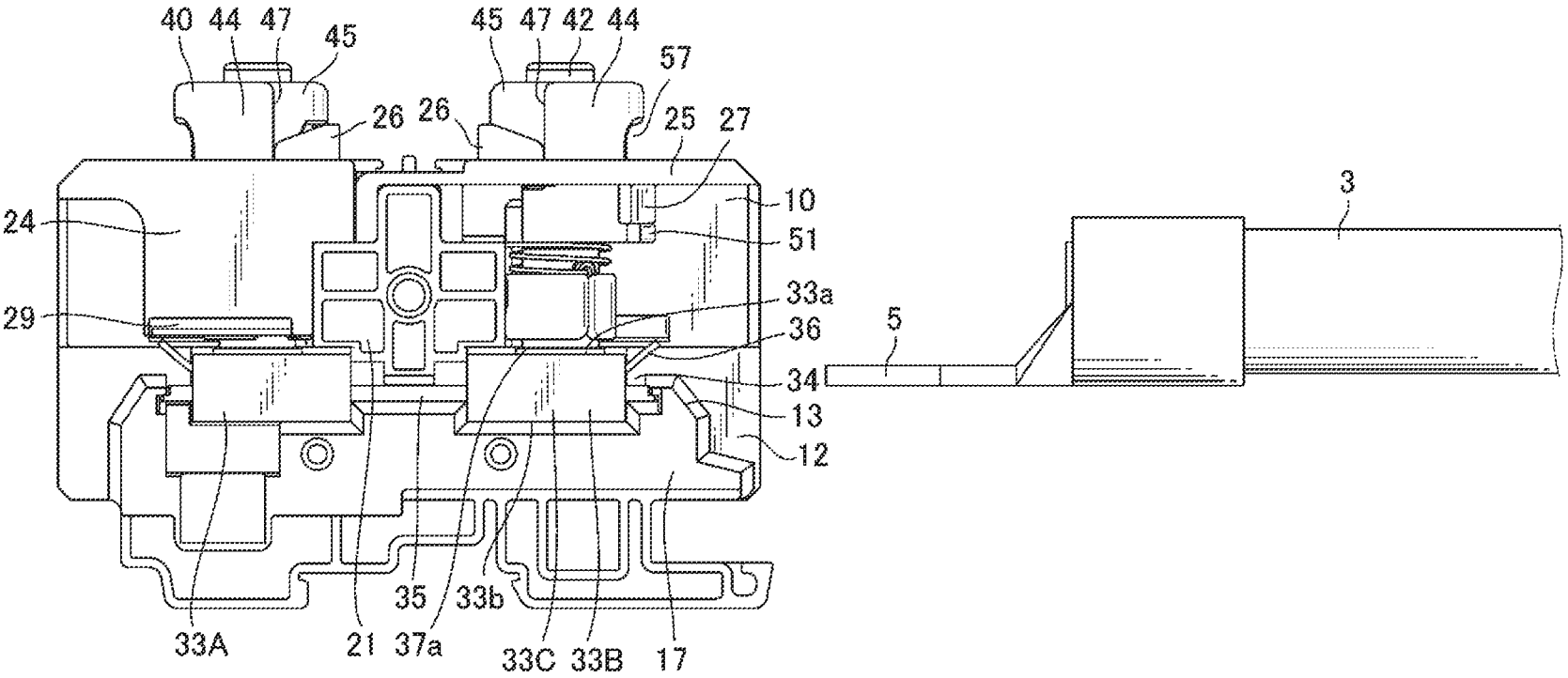
FIG. 3 is a side view of the terminal attaching/detaching device according to the embodiment of the present invention.

FIG. 1 is a perspective view showing an example of a terminal attaching/detaching device 1 according to an embodiment of the present invention. FIG. 2 is a perspective view revealing an inner configuration of the terminal attaching/detaching device 1, from which a side wall 28 is removed. FIG. 3 is a side view of FIG. 2. The terminal attaching/detaching device 1 has a generally laterally symmetrical shape as a whole. All parts thereof may not have complete lateral symmetrical shapes, but they are considered to be substantially laterally symmetrical in view of application of the present invention. Therefore, in the description below, even when description is provided only for one side, it is possible to assume that the other side is configured similarly.

In the embodiment, the terminal attaching/detaching device 1 includes a housing 10, a clamping device 30, an engaging member 70, and a pressing member (movable member) 40. The clamping device 30 is disposed inside the housing 10. The engaging member 70 and the pressing member (movable member) 40 are attached to the housing 10 in a movable state while exposing at least a part thereof to outside. As will be described below, the pressing member 40 moves only up and down in the direction "β" indicated with an arrow in the figure. On the other hand, the engaging member 70 can move up and down in the direction "β" indicated with the arrow, and also can rotate in the direction "γ" indicated with an arrow in the figure. Here, only operation a user can directly perform is pressing the pressing member 40. The engaging member 70 just operates in concert with the pressing member 40 in the process of moving the pressing member 40.

In the embodiment, the housing 10 includes a base body (which is well shown in FIG. 4, which will be described later), a side wall 28, and an upper cover 25. The base body 11 forms a bottom portion 17 and one side portion 14 of the housing 10. The side wall 28 composes the other side portion in the housing 10, while facing the one side portion 14. The upper cover 25 forms an upper portion of the housing 10.

As shown in FIG. 1, on a main body portion 25*a* of the upper cover 25, there is provided a through hole 25*d*. From the through hole 25*d*, a part of the pressing member 40 may be taken outside (the housing). Each of the pressing member 40 is always partially held in the through hole 25*d*, so as to be supported at a specific position in the housing 10.

As shown in FIG. 3, on one side surface of the main body portion 25*a* of the upper cover 25, there is provided a side plate portion 24 that extends in an up-and-down direction of the main body portion 25*a*. Furthermore, on an end edge of the side plate portion 24, there is provided an attachment piece 29, which protrudes in a left-and-right direction in the figure. After attaching the upper cover 25 to the base body 11, the attachment piece 29 provided on the side plate portion 24 is fit to a specified hole (a hole equivalent to a securing hole 14*a* of FIG. 4) provided on the side wall 28. As a result, it is possible to secure the side wall 28 on the upper cover 25.

As shown in FIG. 2, the clamping device 30 may include, for example, a bus bar 35 and a set of spring terminals 33 (i.e., 33A and 33B in the figure). The bus bar 35 is made of a conductive member such as iron. More specifically, the bus bar 35 may be made, for example, using a flat sheet metal that has a certain thickness and has a rectangular shape when viewed from thereabove.

In the embodiment, each of the spring terminals 33A and 33B may be made, for example, using a terminal having an upper part 33*a* and a lower part 33*b*, which are joined with a center part 33*c*. The spring terminals 33A and 33B may be provided so as to put one each on the left and right sides of the bus bar 35, so as to interpose the bus bar 35 between the upper part 33*a* and the lower part 33*b*. In this state, the spring terminals 33A and 33B are secured inside the housing 10.

For example, a set of terminals 5, each of which is attached to one end of a cable 3, may be attached to/detached from the terminal attaching/detaching device 1. Furthermore, it is also possible to electrically connect the attached terminals 5A and 5B to each other via an electrically connecting mechanism provided by the bus bar 35 and spring terminals 33. Here, as a preferred terminal, a round terminal, i.e., a terminal 5 having a through hole 5*a* at a generally center of its flat surface, may be used. Needless to say, terminals that can be used in the device 1 may not be limited to round terminals.

As obvious from the above description, the terminals 5 can be any as long as they can engage with the engaging members 70. For example, the terminals 5 may have a concave portion at the position of the through hole 5*a*, instead of having the through hole 5*a*. Alternatively, the terminals 5 can have a rectangular shape on its top view.

As shown in FIG. 1, on each of the front and back sides of the housing 10, there is provided an opening 12 so as to face each other. Into the openings 12, the terminals 5 are inserted. Each of the terminals 5A and 5B is inserted in the housing 10 through those openings 12.

More specifically, those terminals 5A and 5B are inserted in directions to get close to gap 34 formed between the spring terminals 33A and the bus bar 35, or pulled therefrom in directions to be away from each other. Each of the terminals 5A and 5B may be inserted therein/pulled therefrom, for example, along directions "α1" and "α2" indicated with arrows in the figure. The directions "α1" and "α2" are perpendicular to the moving direction "β" of the pressing members 40.

When the insertion direction "α" and the moving direction "β" of each of the pressing members 40 are perpendicular to each other, it is achievable to simplify the configuration of the device 1. In order to smoothly guide the terminals 5 into the gap 34, it is also possible to provide guiding portions 36 at ends of upper parts 33*a* of the spring terminals 33.

As shown in FIG. 2, near the center of the upper part 33*a* of each of the spring terminals 33, there is provided a through hole 37 so as to be able to put a part of the engaging member 70, i.e., the engaging portion 82, therethrough. The engaging members 70 can engage with the terminal 5 through the through holes 37.

When attached to the device 1, the through holes 5*a* of the terminals 5 are brought to under the upper parts 33*a* of the spring terminals 33, while being aligned with the through holes 37 of the spring terminals 33. As a result, the engaging portions 82 of the engaging members 70 can penetrate into the through holes 5*a* of the terminals 5 as well as the through holes 37 of the spring terminals 33. When the engaging members 82 are inserted in the through holes 5*a* of the terminals 5 through the through holes 37 of the spring terminals 33, flat abutting portions 83 provided on the ends of the engaging portions 82 contact with a surface of the bus bar 35 disposed under the terminals 5.

As a result, the engaging members 70 and the terminals 5 are engaged. In this case, even when one tries to pull out the terminals 5 from the housing 10, the engaging portions 82 are caught by the holes 5*a* of the terminals 5, so that it is impossible to pull out the terminals 5.

In the embodiment, the abutting portions 83 may be preferably formed as flat surfaces so as to increase contact areas with the bus bar 35. When the abutting portions 83 are formed as flat surfaces, it is achievable to more stably maintain the engaged state. In addition, as described above, the terminals 5 can have concave portions instead of the through holes 5*a*. However, when the terminals 5 have the through holes 5*a*, it is achievable to more strongly hold the terminals 5 with the engaging members 70 than when the terminals 5 have simple concave portions.

In the embodiment, the through holes 37 are formed by punching one surface of each of the spring terminals 33 toward the other surface thereof. On each of the upper parts 33*a*, there is provided a rising portion 37*a* formed by punching. A part near the end portion of each of the engaging members 70 is always held by the spring terminal 33 with the rising portion 37*a*. As a result, it is possible to stably position the engaging members at specific positions in the housing 10.

Figure 4:
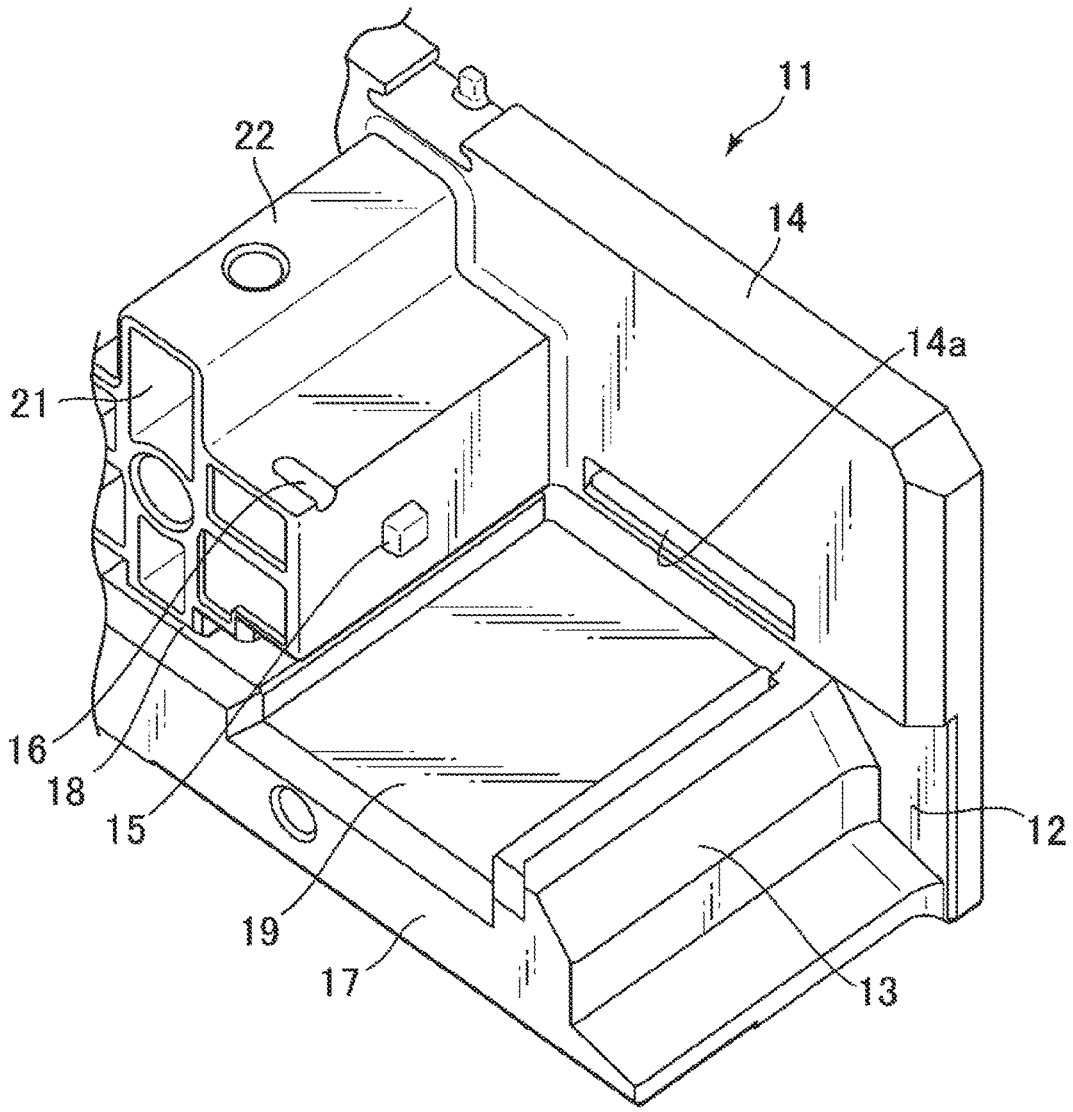
FIG. 4 is a schematic perspective view showing a base body of a housing of the terminal attaching/detaching device according to the embodiment of the present invention.

FIG. 4 is a schematic perspective view showing the base body 11 that composes a part of the housing 10. The figure shows a part of the right-side part and a center part of the base body 11. However, as already described above, the left-side part thereof is considered to be configured similarly to the right-side part. The base body 11 mainly includes a bottom portion 17, side portions 14, and a main body portion 21. The side portions are perpendicularly disposed from the bottom portion 17. The main body portion 21 is joined to the bottom portion 17 via the side portions 14.

On an upper surface of the bottom portion, there is provided a dented portion 19. On the dented portion 19, lower parts 33*b* of the spring terminals 33 attached to the bus bar 35 are to be disposed. Between the bottom portion 17 and the main body portion 21, there is provided a gap 18, into which the bus bar 35 are to be inserted. The spring terminals 33A and 33B are attached on the left and the right sides of the bus bar 35. The clamping device 30 may be attached to the base body 11, by inserting the bus bar 35 to the gap 28 at an exposed part near the center between the spring terminals 33A and 33B.

A part 52*a* of the main body portion 25*a* of the upper cover 25 is disposed on a top portion 22 of the main body portion 21. Then, the attachment pieces 29 of the side plate portion 24 provided on one side surface of the main body portion 25*a* of the upper cover 25 is inserted in securing holes 14*a* provided on the side portion 14. As a result, the upper cover 25 may be secured on the base body 11.

In the embodiment, the main body portion 21 has a protrusions 15 and spring attachment grooves 16. Each of the protrusions 15 can engage with a part of the engaging member 70 (a guiding groove 84 of the engaging member 70). To each of the spring attachment grooves 16, one end of the urging portion (the coil spring 7 shown in FIG. 9, etc.) that can control rotation of the engaging member 70 is to be secured.

Figure 5:
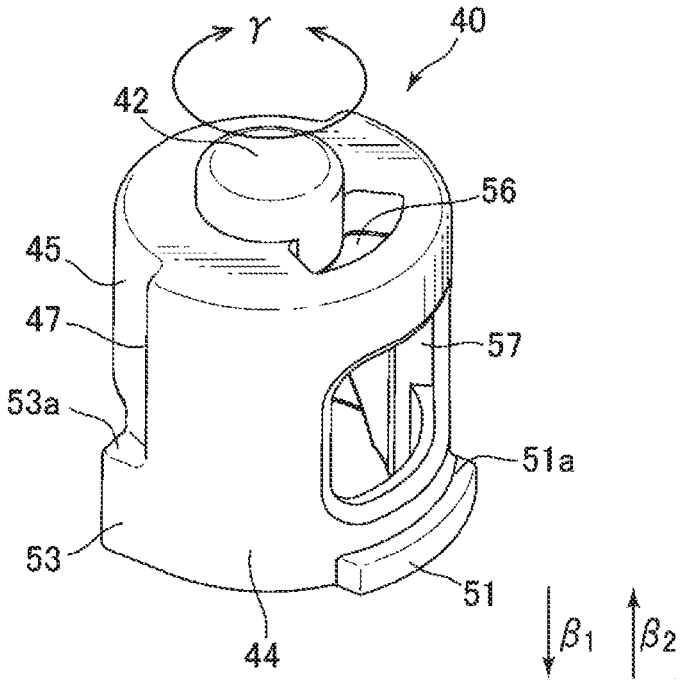
FIG. 5 is an upper perspective view showing a pressing member of the terminal attaching/detaching device according to the embodiment of the present invention.
Figure 6:
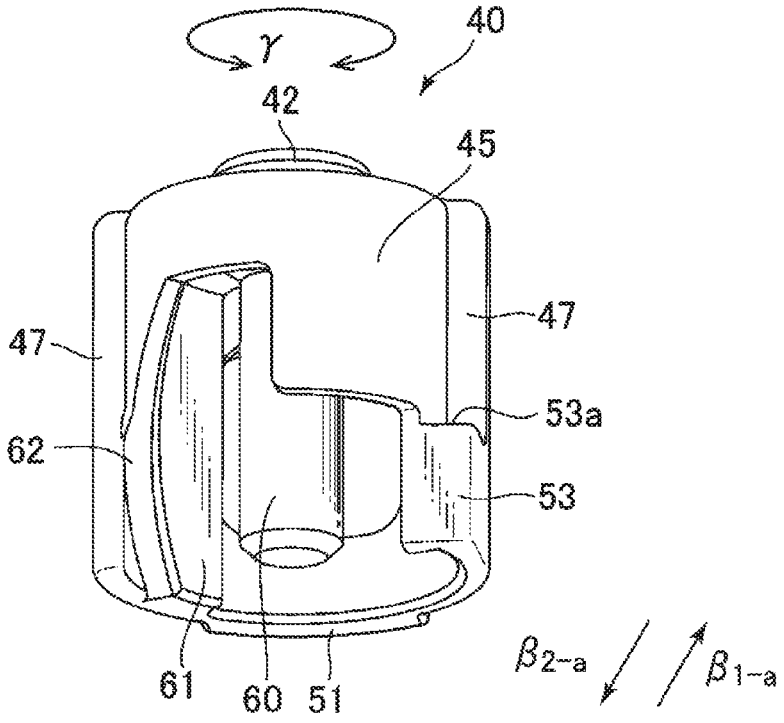
FIG. 6 is a schematic side perspective view showing the pressing member of the terminal attaching/detaching device according to the embodiment of the present invention.
Figure 7:
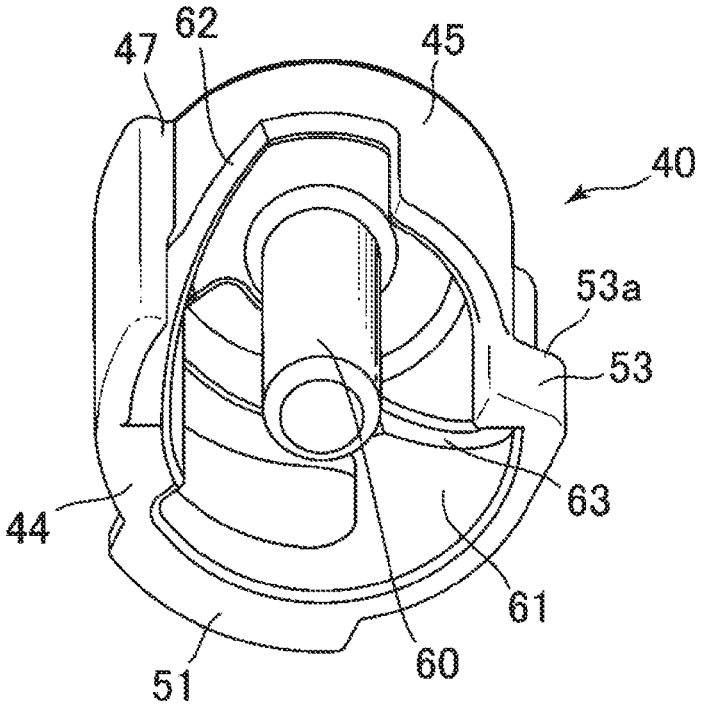
FIG. 7 is a bottom perspective view showing the pressing member of the terminal attaching/detaching device according to the embodiment of the present invention.

FIGS. 5 through 7 show an upper perspective view, a schematic side perspective view, and a bottom perspective view of the pressing member 40, respectively.

Each of the pressing members 40 has a generally bell shape, that is laterally symmetrical. Inside each of the pressing members 40, there is formed accommodating space 61 for the engaging member 70. In the accommodating space 61, at least a part of the engaging member may be accommodated. In order to restrict movement of each of the engaging members 70, in the accommodating space 61, there is provided a shaft 60, which extends downward from an inner wall of the ceiling part thereof. Each of the engaging members 70 moves up/down in the direction "β", along the shaft 60. In addition, each of the engaging members 70 can rotate in the direction "γ" around the shaft 60. On the other hand, the pressing members can move only up/down in the direction "β" along the shaft 60.

In the embodiment, each of the pressing members 40 has a front-side large-diameter portion 44 and a rear-side small-diameter portion 45. Each of the front-side large-diameter portion 44 is provided on the front side and has a larger diameter. Each of the rear-side small-diameter portion 45 is provided on the rear side and has a smaller diameter. With the difference in diameters between the front-side large-diameter portions 44 and the rear-side small-diameter portions 45, there are formed back-side abutting portions 47 at boundary parts therebetween, which extend in the left-and-right direction. The back-side abutting portions 47 abut corresponding parts of the through holes 25*d* of the upper cover 25, and serve to move the pressing members 40 up/down at certain positions without accompanying rotational movements.

On the bottom side of each of the front-side large-diameter portions 44, there is provided a front protruding portion 51. In addition, near the bottom side of the border between the front-side large-diameter portion 44 and the rear-side small-diameter portion 45, more specifically one of the left and the right front-side large-diameter portions 44 (the right side viewed from the front in the embodiment), there is provided a rear protruding portion 54. The rear protruding portion 54 projects backward. The action of the rear protruding portion 54 will be described later.

In the embodiment, each of the rear-side small-diameter portions 45, e.g., thick part thereof, has a sloped portion 62 and 63, which are sloped relative to the moving directions of the pressing member 40 with an acute angle of "β1-a" and "β1-a". Here, as an example, sliding surfaces 62 and 63 are used as the sloped portion. However, needless to say, the sloped portion may not be limited to the sliding surfaces 62 and 63. According to the embodiment, two sliding surfaces are provided. However, the number of the sliding surfaces may not have to be two. The sliding surface may be provided only on one side.

Alternatively, three or more sliding surfaces may be provided at suitable positions. Each of the engaging members 70 has an engaging portion corresponding to the sloped portions 62 and 63. The engaging portion may be any as long as the engaging portion can engage with the sloped portion in the process of moving the pressing member 40. Here, as an example, a set of protruding portions (side protruding portions 73 shown in FIG. 8, etc.) is provided. In the process of moving each of the pressing members 40, those protruding portions can slide on the sliding surfaces 62 and 63.

In the embodiment, for a purpose of simplification, the directions "β1" and "β2" may be set completely opposite directions. However, those directions do not have to be completely opposite each other, and may be directed in different directions.

In order to make pressing of the pressing members 40 easier, pressing portions 42 could be provided. On a front side of each of the pressing portion 42, there is provided an upper window 53, which is generally fan-shaped. On a front side of each of the front-side large-diameter portions 44, there is provided a side window, which generally has a rectangular shape. Through those windows 56 and 57, a user can monitor the behavior of the engaging members 70 in the inner space 61, and easily see the engagement state of the engaging members 70 and the terminals 5. As a result, for example, it is achievable to effectively prevent incomplete fitting.

Figure 8:
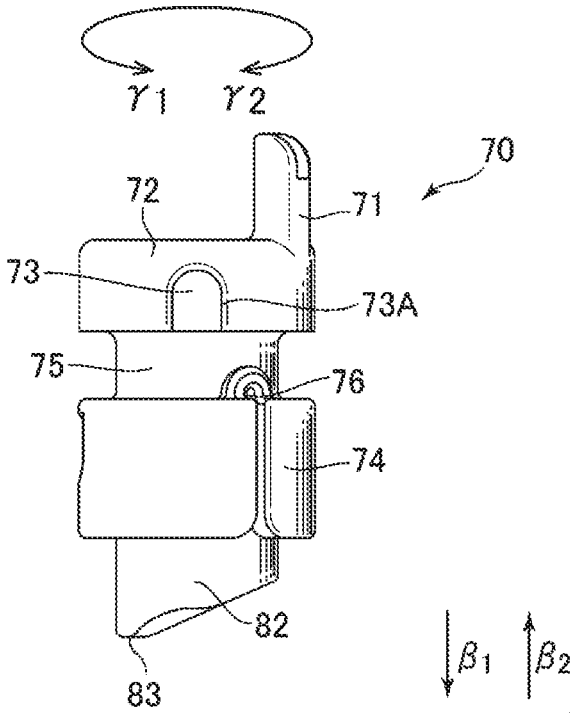
FIG. 8 is a side view showing an engaging member of the terminal attaching/detaching device according to the embodiment of the present invention.
Figure 9:
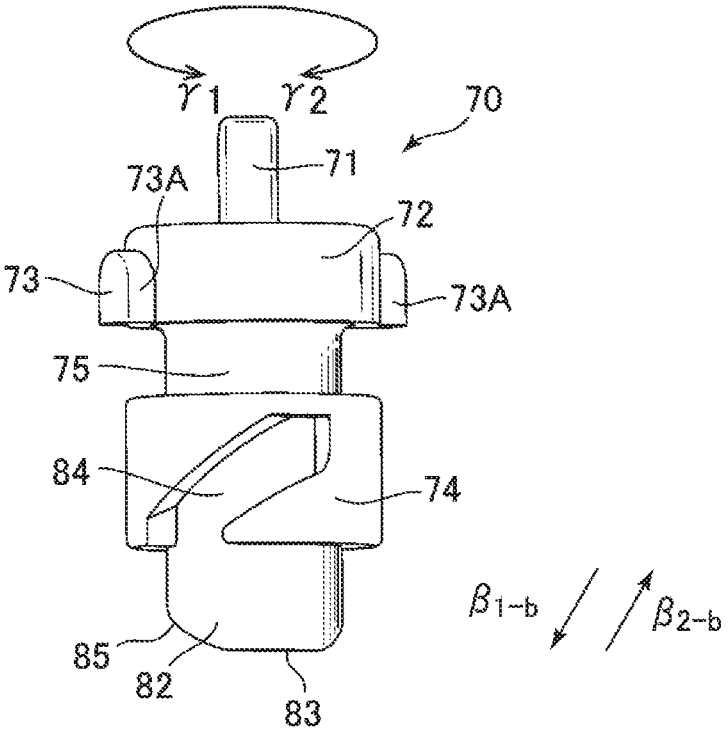
FIG. 9 is a back view showing the engaging member of the terminal attaching/detaching device according to the embodiment of the present invention.
Figure 10:
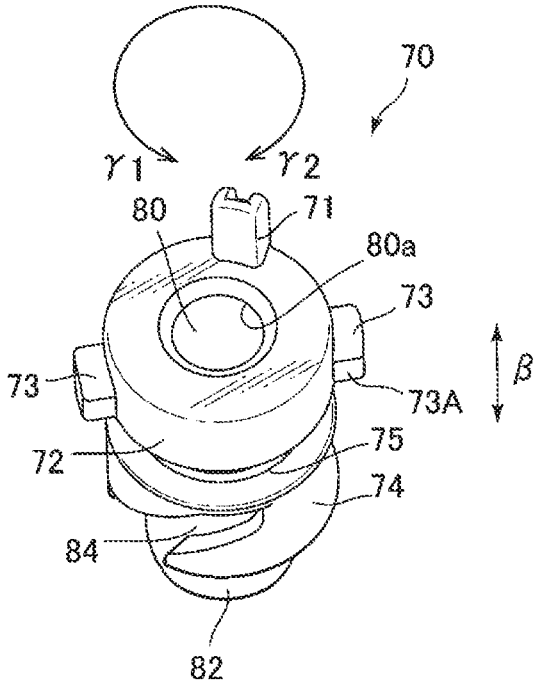
FIG. 10 is an upper perspective view of the engaging member of the terminal attaching/detaching device according to the embodiment of the present invention.

FIGS. 8 through 10 are a side view, a back-side view, and an upper perspective view of the engaging member 70, respectively. Each of the engaging members 70 generally has a cylindrical shape as a whole. In the accommodating space 61 for the pressing member 40, the engaging member 70 moves up/down in the direction "β" along the shaft 60, and rotates in the direction "γ" around the shaft 60.

In the embodiment, each of the engaging members 70 generally includes four parts, i.e., an upper large-diameter portion 72, a lower large-diameter portion 74, a spring winding portion 75, and an engaging portion 82. The upper large-diameter portion 72 is provided at the top. The lower large diameter portion 74 is provided under the upper large-diameter portion 72. The spring winding portion 75 is provided between the upper large-diameter portion 72 and the lower large-diameter portion 74.

In the embodiment, the engaging portion 82 is provided at the lowest. The diameters of the upper large-diameter portion 72 and the lower large-diameter portion 74 are generally the same. The sizes of those diameters are set generally the same as or slightly smaller than inner diameter of the accommodating space 61 of the pressing member 40. The diameters of the spring winding portion 75 and the engaging portion 82 are also set generally the same, but smaller than those of the upper large-diameter portion 72 and the lower large-diameter portion 74.

In each of the spring winding portion 75, there is provided a spring attachment hole 76, to which one end of the urging portion (i.e., the coil spring 7 shown in FIG. 15, etc.) is secured. The other end of the urging portion is to be secured in the spring attachment groove 16 provided in the main body 21 of the housing 10. Each of the engaging members 70 could be always urged in specific directions, i.e., the directions "β1" and "γ2".

On a top surface of each of the upper large-diameter portions 72, there is provided a vertical hole 80, to which the shaft 60 of the pressing member 40 is to be inserted. In order to make insertion of the pressing member 40 easy, it is also possible to provide a taper on an insertion hole 80*a* of each of the vertical holes 80. While it is not obvious from the figures, each of the vertical holes 80 extends along the direction "β", having a length from the upper large-diameter portion 72 to the lower large-diameter portion 74. In other words, each of the vertical holes 80*a* has an enough length to receive the shaft 60.

In an annular part outside a top surface of each of the upper large-diameter portions 72, there is provided an indication portion 71. Each of the indication portions 71 is perpendicularly provided to extend upward, i.e., in the direction "β2", and has a free end. It is possible to visually check the behavior of the indication portions 71 through the windows provided on the pressing members 40, even when the engaging members 70 are accommodated in the pressing members 40. In order to improve visibility to check the indication portions 71, the color of the indication portions 71 may be preferably set to the one that can be clearly distinctive from that of the pressing members 40.

At a position facing to a circumferential surface of each of the upper large-diameter portions 70, there are provided two side protrusions 73. Those side protrusions 73 protrude outward corresponding to the sliding surfaces 62 and 63 of each of the pressing members 40. When the engaging members 70 are accommodated in the accommodating spaces of the pressing members 40, those side protrusions 73 abut the sliding surfaces 62 and 63 provided in the pressing members 40 at their side circumferential surfaces 73A.

As a result, they can engage each other. In each of the thick portions 73A, especially the parts that can abut against the sliding surfaces 62 and 63 form smooth curved surfaces. Therefore, the side protrusions 73 can smoothly slide thereon. As an example, the shape of the side surfaces is set as longitudinally long rectangular shape, which has an arc-shaped projecting part. However, needless to say, the shape of the side surfaces may not be limited to such shape, and for example, can be a generally circular shape when viewed on the side surface, which has a smooth curved surface.

On surfaces on the back sides of the lower large-diameter portions 74, there are provided sloped portions that are sloped in acutely angled directions "β1-b" and "β2-b" relative to the moving directions "β1" and "β2" of each of the pressing members 40. As shown in the illustrated example, the sloped portion may be, for example, guiding grooves 84, each of which is formed by the difference of the diameters of the lower large-diameter portion 74 and the engaging portion 82.

When the engaging members 70 are accommodated in the accommodating spaces 61 of the pressing members 40, the protrusions 15 of the housing 10 are disposed in the guiding grooves 84, and the protrusions 15 and the guiding grooves 15 engage each other.

In the embodiment, the guiding grooves 84 are shown as the sloped portion and the protrusions 15 are shown as members to engage with the sloped portion. However, needless to say, the sloped portion and members to engage with the sloped portions are not limited to those. The sloped portions and members to engage with the sloped portions can be any as long as the sloped portions are sloped and the members to engage with the slope portions have a function of engaging with the sloped portions. Here, at the end of engaging portion 82 of each of the engaging members 70, preferably, there is formed a sloped surface 85 for alleviating collision against the terminals 5, which will be described later.

Referring now to FIGS. 11 through 14, working principle of the engaging members 70 will be described. Those figures are schematic perspective views, in which only the pressing member 40, the engaging member 70, and the protrusion 15, which is a part of the housing 10, are extracted from the device 1, while keeping those physical relationship. Those figures show how the engaging member 70 moves in concert with the pressing member 40 in the process of moving the pressing member 40.

Figure 11:
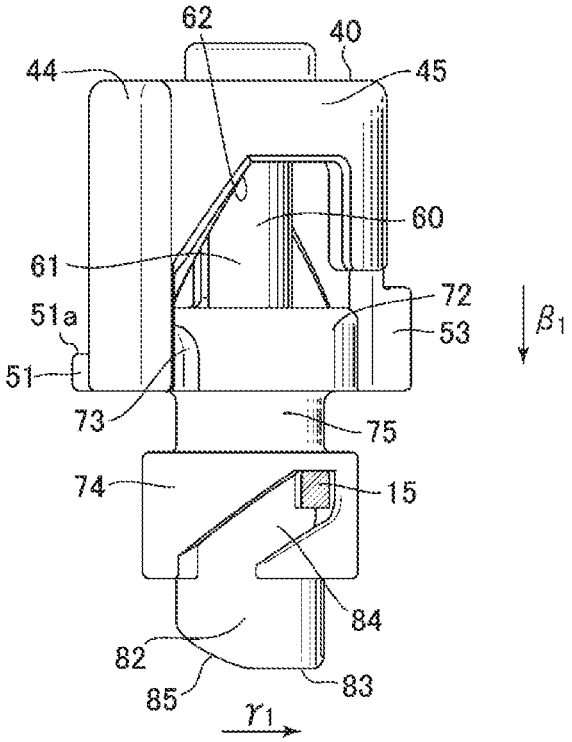
FIG. 11 is an explanatory view showing how the engaging member works of the terminal attaching/detaching device according to the embodiment of the present invention.
Figure 12:
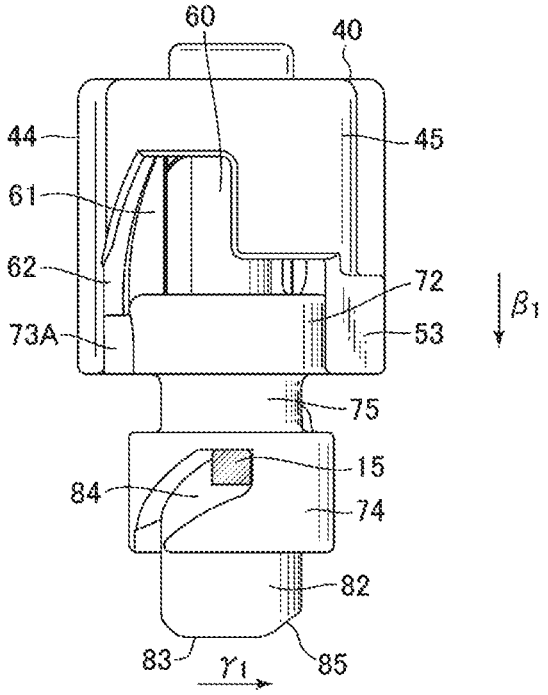
FIG. 12 is an explanatory view showing an operation of the engaging member of the terminal attaching/detaching device according to the embodiment of the present invention.
Figure 13:
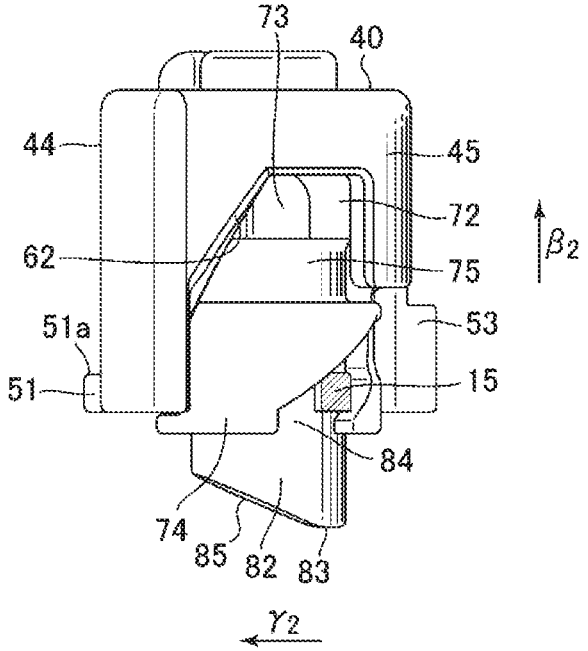
FIG. 13 is an explanatory view showing the operation of the engaging member of the terminal attaching/detaching device according to the embodiment of the present invention.
Figure 14:
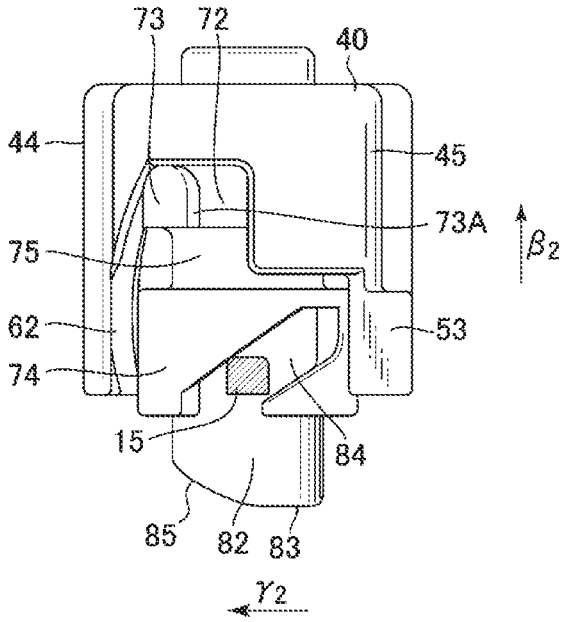
FIG. 14 is an explanatory view showing the operation of the engaging member of the terminal attaching/detaching device according to the embodiment of the present invention.

Here, FIGS. 11 and 12 show the state before the pressing member 40 moves in the direction "β1" or the state after the pressing member 40 moved in the direction "β2", which are shown in directions different from each other. FIGS. 13 and 14 show the state before the pressing member 40 moves in the direction "β2" or the state after the pressing member 40 moved in the direction "β1", which are shown in directions different from each other. FIGS. 11 and 13 and FIGS. 12 and 14 are shown in the same directions.

In all of those figures, the housing 10 is assumed to stay still. Therefore, the positions of the protrusions 15 of the housing 10 will not move. In addition, the engaging members 70 are supposed to be always urged in a direction to be away from the pressing members 40 along the direction "β" and the rotational direction "γ2" by the urging portion (i.e., coil springs 7 shown in FIG. 19, etc.)

As obvious, the shafts 60 of the pressing members 40 are always in the state of being inserted in the vertical holes 80 of the engaging members 70. In addition, at least a part of each of the engaging members 70 is in the state of being inserted in the accommodating space 61 of the pressing member 40. Therefore, according to the configuration, the pressing members 40 and the engaging members 70 are align to each other in their moving directions, for example, along the direction in the direction "β". As a result, it is achievable to reduce the space to dispose the pressing members 40 and the engaging members 70.

Upon changing from the state of FIGS. 11 and 12 to the state of FIGS. 13 and 14, more specifically, when the pressing members 40 move in the direction "β1" relative to the engaging members 70 and the housing 10, or when the pressing members 40 move toward the terminals 5 inserted in the housing 10, the pressing members 40 rotate the engaging members 70 relative to the pressing members 40 in the direction "γ1".

In the embodiment, the pressing members 40 make the rotational movement in concert with the engaging members 70 in the moving process through the engagement between the sliding surfaces 62 and 63 of the pressing members 40 and the side protruding portions 73 of the engaging members 70. Furthermore, the protrusions 15 of the housing 10 are provided in the guiding grooves of the engaging members 70. Therefore, at this point, the engaging members 70 move in the direction "β2" to get close to the pressing members 40 through the engagement between the guiding grooves 84 of the engaging members 70 and the protrusions 15 of the housing 10.

On the other hand, upon changing from the state of FIGS. 13 and 14 to the state of FIGS. 11 and 12, more specifically, when the pressing members 40 move in the direction "β2" relative to the engaging members 70 and the housing 10, or when the pressing members move in the direction to be away from the terminals 5 inserted in the housing 10, the pressing members 40 rotate the engaging members 70 relative to the pressing members 40 in the direction "γ2".

In the embodiment, the pressing members 40 make the rotational movement in concert with the engaging members 70 in the moving process through the engagement between the sliding surfaces 62 and 63 of the pressing members 40 and the side protruding portions 73 of the engaging members 70.

Furthermore, the protrusions 15 of the housing 10 are provided in the guiding grooves 84 of the engaging members 70. Therefore, at this point, the engaging members 70 move in the direction "β1" to be away from the pressing members 40 through the engagement between the guiding grooves 84 of the engaging members 70 and the protrusions 15 of the housing 10.

Figure 19:
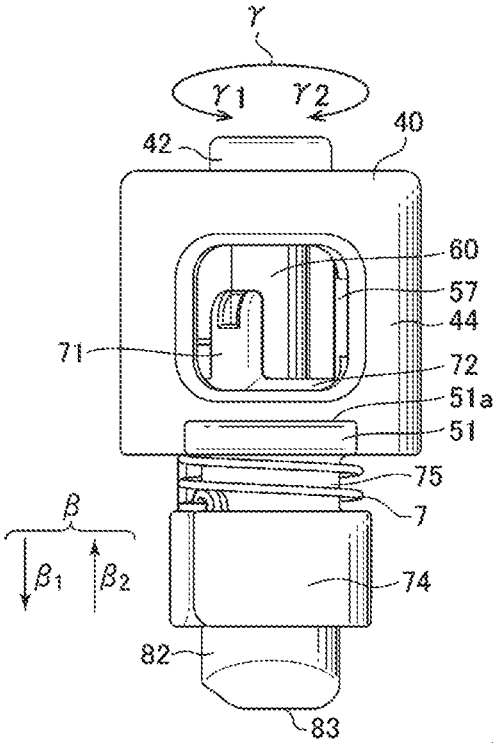
FIG. 19 is a front view showing the pressing member, the engaging member, and a coil spring of the terminal attaching/detaching device according to the embodiment of the present invention.

Here, even when the pressing members 40 move in the direction to be away from the terminals 5 inserted in the housing 10, the engaging members 70 are always urged in the direction to be away from the pressing members 40 along the direction "β" and in the rotational direction "γ2", by the urging portion (the coil springs 7 shown in FIG. 19, etc.). Therefore, the engagement between the sliding surfaces 62 and 63 of the pressing members 40 and the side protruding portions 73 of the engaging members 70 and the engagement between the guiding grooves 84 of the engaging members 70 and the protrusions 15 of the housing 10 will not be released.

As described above, according to the configuration, when the pressing members 40 are moved in the direction "β1", relative to the engaging members 70 and the housing 10, and the engaging members 70 are rotated in the direction "γ1" relative to the pressing members 40, the engaging members 70 are moved in the direction "β2" relative to the pressing members 40 through the engagement between the guiding grooves 84 and the protrusions 15.

On the other hand, when the pressing members 40 are moved in the direction "β2" relative to the engaging members 70 and the housing 10 and the engaging members 70 are rotated in the direction "γ2" relative to the pressing members 40, the engaging members 70 can be moved in the direction "β1" relative to the pressing members 40 via the engagement between the guiding grooves 84 and the protrusions 15.

As a result, through operation of the pressing members 40, it is possible to engage the engaging members 70 with the terminals 5, or release the engagement between the engaging members 70 and the terminals 5. As obvious, according to the configuration, the direction "β1" to move the pressing members 40 in order to release the engaging members 70 and the terminals 5 is different from the direction "β2" that the engaging members 70 move from the terminals 5 upon releasing the engagement between the engaging members 70 and the terminals 5.

Therefore, it is achievable to release the engagement between the engaging members 70 and the terminals 5 through the operation of pressing the pressing members 40 instead of moving the engaging members 70 themselves from the terminals 5. As a result, it is achievable to flexibly apply the terminal attaching/detaching device 1 in various use situations. Furthermore, according to the configuration, it is achievable to operate the engaging members 70 through operating the pressing members 40, instead of the engaging members 70 themselves. Therefore, it is easy to apply the terminal attaching/detaching device 1 in various use situations.

FIGS. 15 through 18 are perspective views showing the state of disposing the engaging members 70 and the pressing members 40, which are shown in FIGS. 11 through 14, in the housing 10. Similarly to FIG. 2, in order to reveal the configuration of inside of the device 1, the side wall 28 is removed in those figures.

On the inner wall of the main body portion **25*a* of the cover 25, a front-side supporting portion 27 is perpendicularly provided inward. On the other hand, on an outer wall of the main body portion 25*a* of the cover 25, a back-side supporting portion 26** is perpendicularly provided outward.

While being interposed between the front-side supporting portion 27 and the back-side supporting portion 26, i.e., while abutting an outer circumferential surface of the front-side large-diameter portion 44 of each of the pressing members the pressing members 40 to an inner circumferential surface of the front-side supporting portion 27, and abutting an outer circumferential surface of the rear-side small-diameter portion 45 of each of the pressing members 40 to an inner circumferential surface of the back-side supporting portion 26, the pressing members 40 can move up/down in the direction "β" indicated with the arrow.

When the pressing members 40 move up/down in the direction "β1", an upper abutting surface 53*a* of the front protruding portion 51, which is provided on the front large-diameter portion 44 of each of the pressing members 40, could collide against a bottom abutting surface 27*a* of the front supporting portion 27. In addition, the upper abutting surface 53*a* of the rear-side small-diameter portion 45 of the pressing member 40 could collide against the inner wall 25*b* of the back surface of the cover 25. As a result, it is achievable to prevent the pressing members 40 coming off from the housing 10.

As described above, the engaging members 70 are always urged in the direction "β1" by the coil springs 7. Under the situation like this, in the state indicated in FIGS. 15 and 16, once the terminals 5 (not illustrated in the figures) are inserted in the gap 34 formed between the spring terminals 33 and the bus bar 35, the terminals 5 push up the engaging members 70, which are always urged, in the direction "β2" against the urging force, especially through the collision against the slope surfaces 85 provided at the ends of the engaging portions 82.

When the terminals 5 are inserted in the gap 34 to certain depths, the engaging portions 82 of the engaging members 70 are inserted in the through holes 5*a* of the terminals 5 through the through holes 37 of the spring terminals 33. As a result, the engaging members 70 move in the direction "β1" indicated with the arrow in the figure. As a result, the terminals 5 engage with the engaging members 70, and the terminals 5 are attached to the terminal attaching/detaching device 1.

In addition, at this time, the terminal 5A inserted from a front-side opening 12 and the terminal 5B inserted from a rear-side opening can electrically contact with the same bus bar 35 through the spring terminals 33. Therefore, the terminals 5A and 5B are electrically relayed each other via the spring terminals 33 and the bus bar 35, without directly connected to each other.

Figure 17:
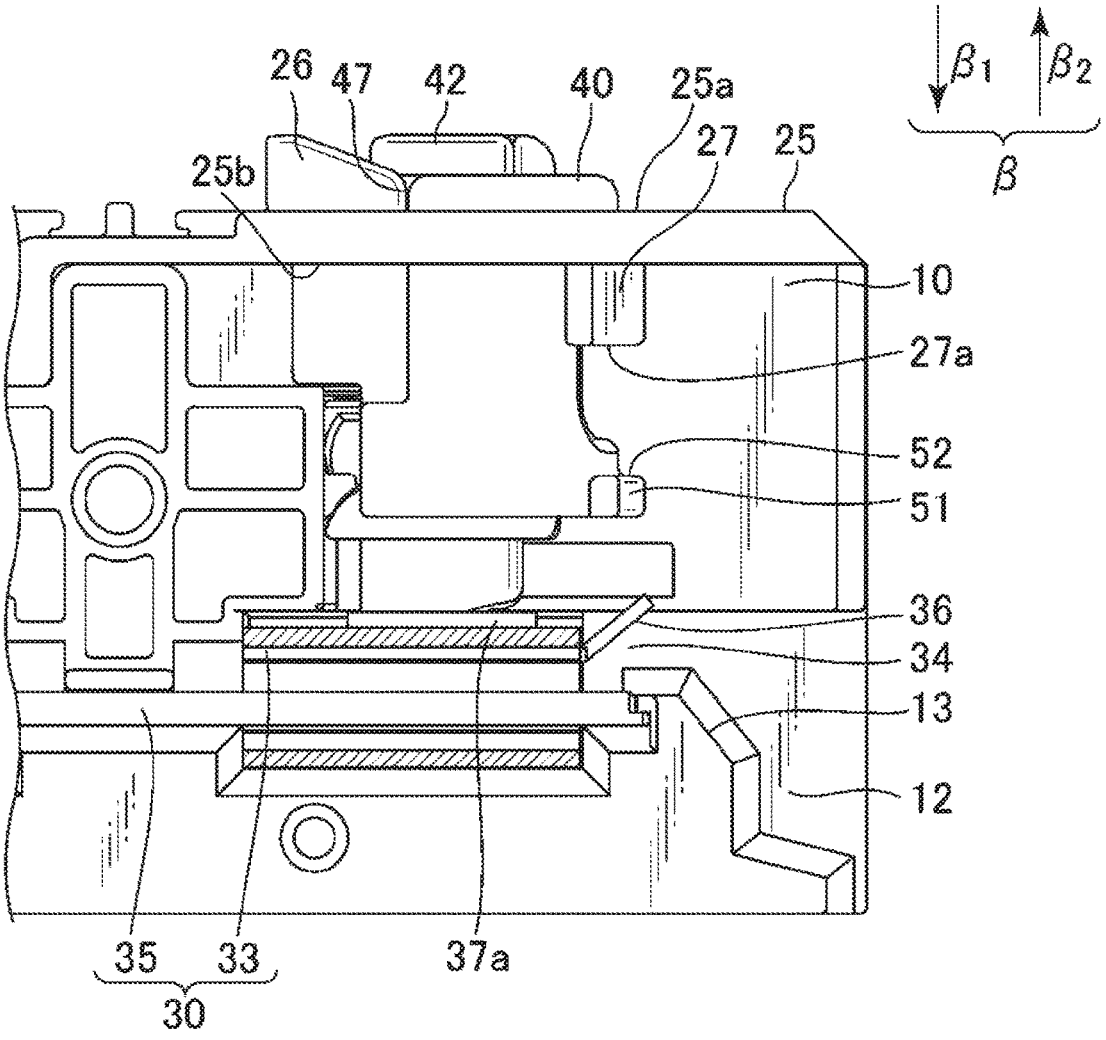
FIG. 17 is a perspective view showing the engaging member and the pressing member in the housing of the terminal attaching/detaching device according to the embodiment of the present invention.
Figure 18:
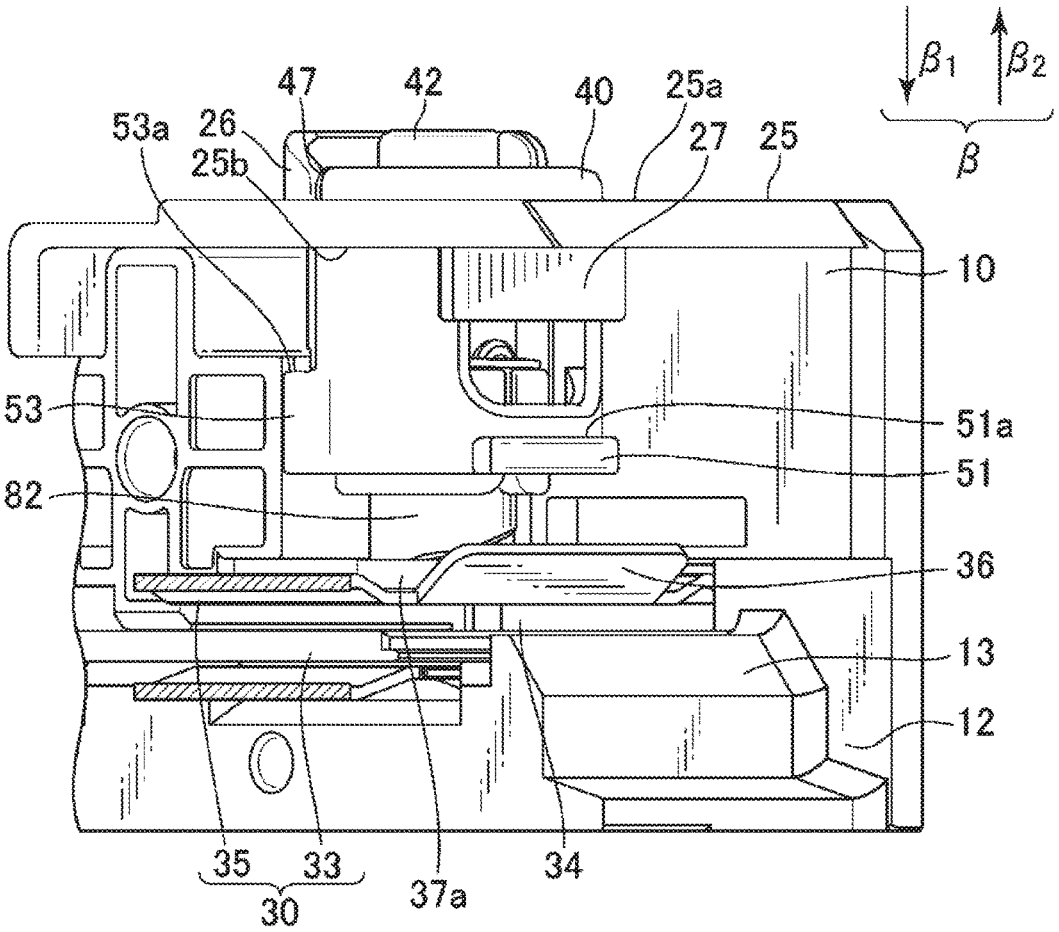
FIG. 18 is a perspective view showing the engaging member and the pressing member in the housing of the terminal attaching/detaching device according to the embodiment of the present invention.

In case of detaching the attached terminals 5, it is just necessary to push the pressing members 40 in the direction "β1", so as to make to the state of FIGS. 17 and 18. The pressing members 40 pushed in the direction "β1" separate the engaging members 70, which are always urged in the direction "β1", in concert with the engaging members 70 as described above in the moving process from the terminals 5 inserted in the housing 10.

As a result, it is achievable to release the engagement between the engaging members 70 and the terminals 5. In this state, pulling the terminals 5A and 5B from the gap 34, it is possible to pull out the terminals 5A and 5B from the terminal attaching/detaching device 1.

Figure 15:
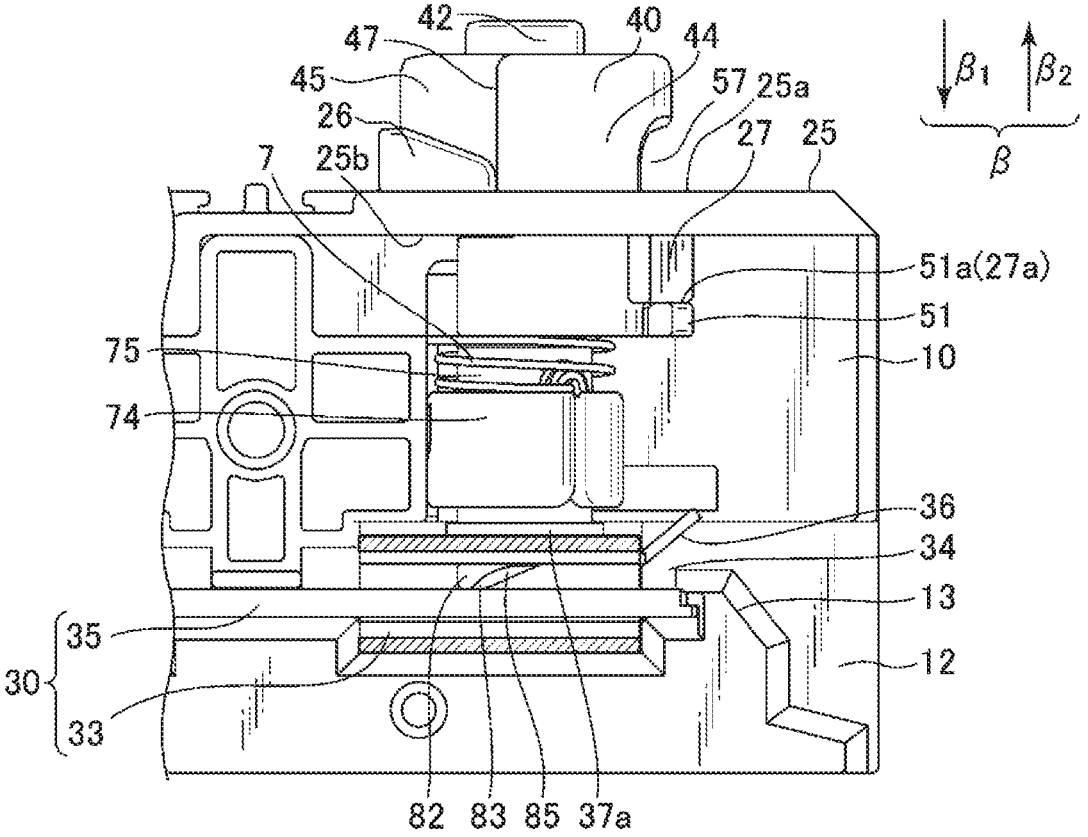
FIG. 15 is a perspective view showing the engaging member and the pressing member in the housing of the terminal attaching/detaching device according to the embodiment of the present invention.
Figure 16:
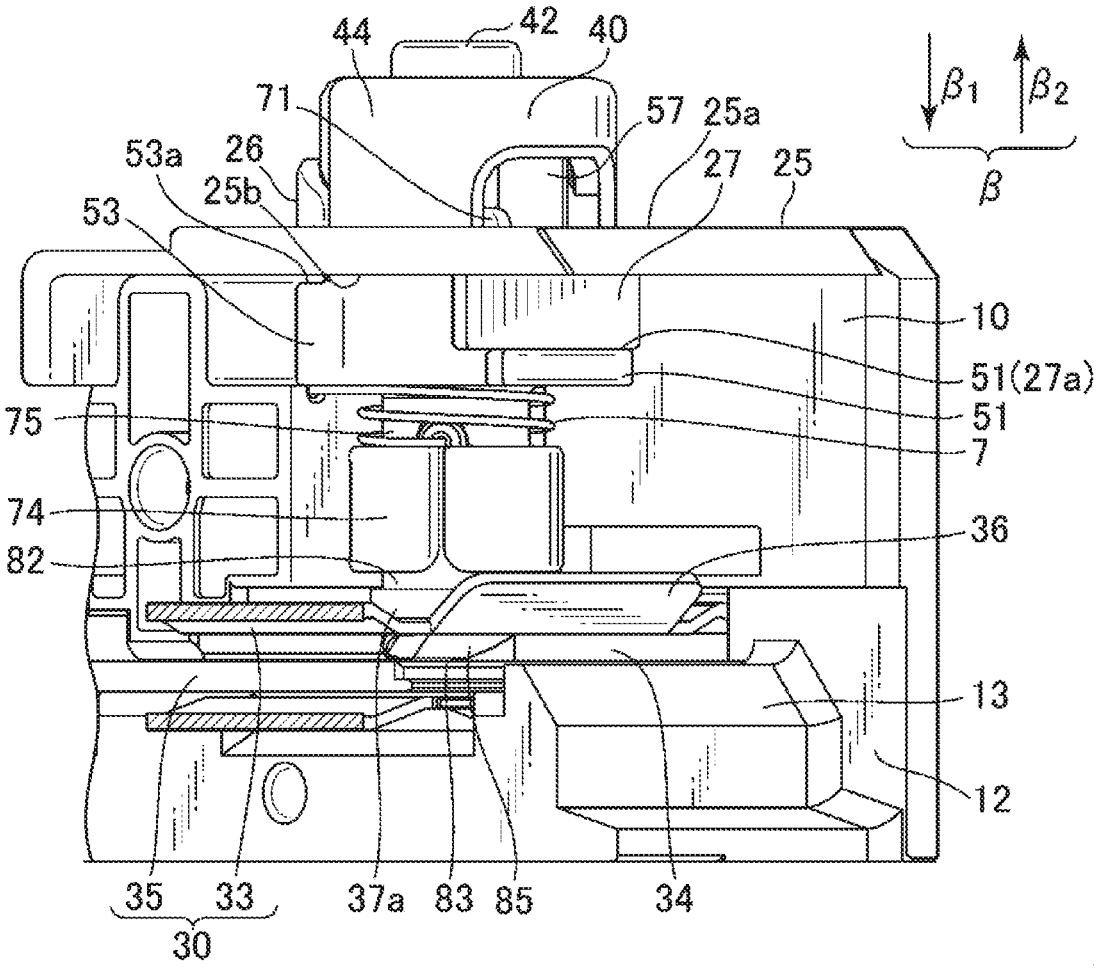
FIG. 16 is a perspective view showing the engaging member and the pressing member in the housing of the terminal attaching/detaching device according to the embodiment of the present invention.
Figure 20:
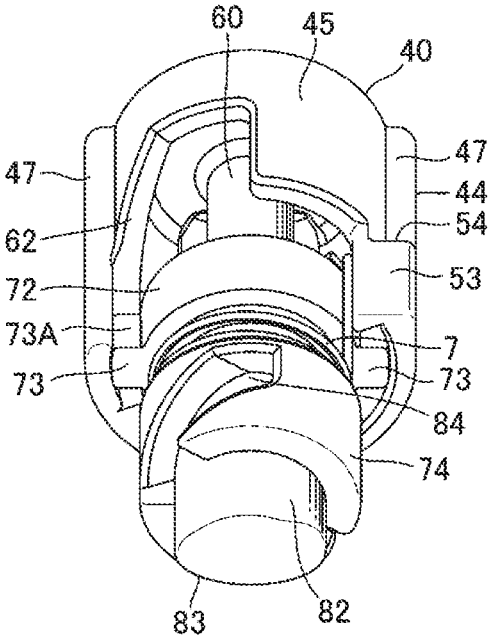
FIG. 20 is a back perspective view showing the pressing member, the engaging member, and the coil spring of the terminal attaching/detaching device according to the embodiment of the present invention.
Figure 21:
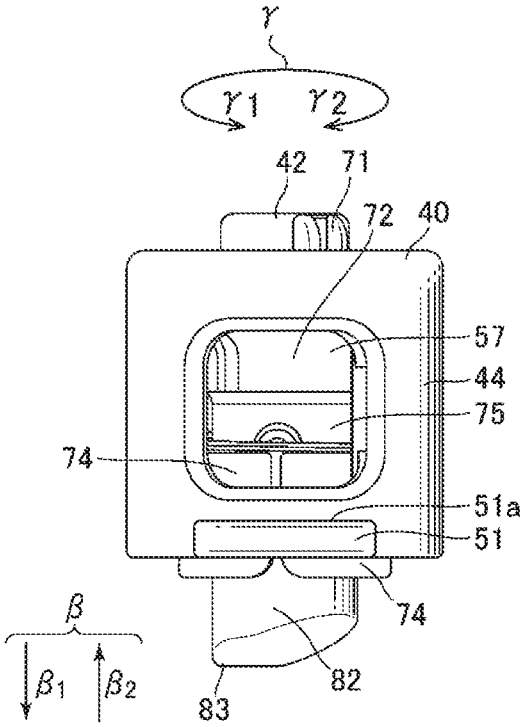
FIG. 21 is a front view showing the pressing member, the engaging member, and the coil spring of the terminal attaching/detaching device according to the embodiment of the present invention.
Figure 22:
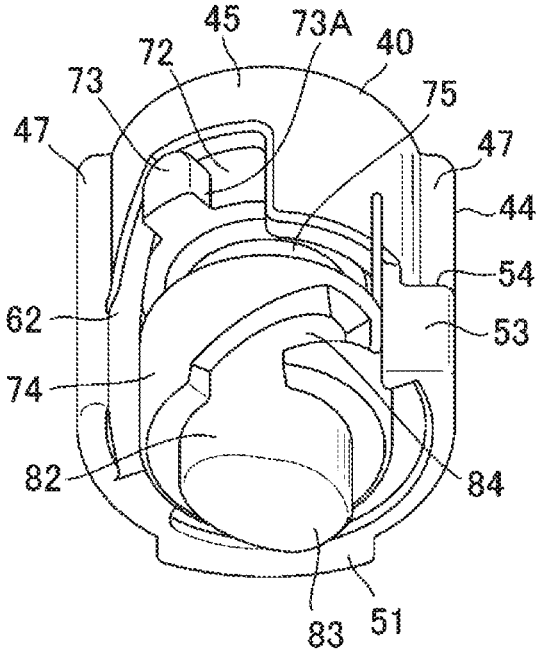
FIG. 22 is a back perspective view showing the pressing member, the engaging member, and the coil spring of the terminal attaching/detaching device viewed from the bottom side according to the embodiment of the present invention.
Figure 23:
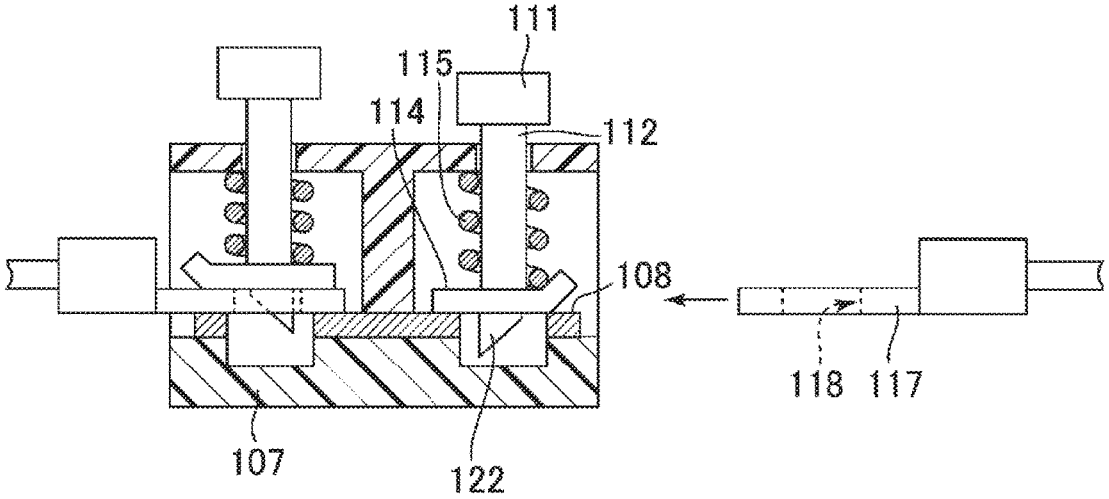
FIG. 23 PRIOR ART
FIG. 23 is a sectional view showing an example of a configuration of a conventional terminal attaching/detaching device.

FIGS. 19 and 20 are perspective views, in which only the pressing member 40, the engaging member 70, and the coil spring 7 are extracted from the device 1 of FIGS. 15 and 16, while keeping their physical relations. FIGS. 21 and 22 are perspective views, in which only the pressing member 40, the engaging member 70, and the coil spring 7 are extracted from the device 1 of FIGS. 17 and 18, while keeping their physical relations. In those figures, FIGS. 19 and 21 are front views, and FIGS. 20 and 23 are back-side perspective views of the bottom side, respectively.

As obvious from FIG. 19, in the state before moving the pressing members 40 in the direction "β2" relative to the engaging members 70 and the housing 10, the indication portions 71 provided on the engaging members 70 are positioned thereunder. Therefore, it is easily visible from the side windows 57.

On the other hand, as obvious from FIG. 20, in the state before moving the pressing members 40 in the direction "β1" relative to the engaging members 70 and the housing 10, the indication portions 71 provided in the engaging members 70 are positioned thereabove. Therefore, it is easily visible from the upper windows 56. Therefore, according to the configuration, it is achievable to easily see the degree of rotation of the engaging members 70, which is in turn the engagement state between the engaging members 70 and the terminals 5. According to the configuration, for example, it is achievable to effectively prevent incomplete fitting. On the cover 25 of the housing 10, it is possible to provide position displays 51*c* (FIGS. 1 and 2), which make easier to check whether the indication portions 71 reach the specified positions.

Here, the present invention is not limited to the above-described embodiment, and various modifications, alterations, variations are possible.

For example, according to the embodiment, upon moving the engaging members 70 in the direction "β", rotation of the engaging members 70 must be accompanied. Alternatively, the engaging members 70 and the pressing members 40 may be on the both ends of a bar, which makes seesaw movement, so as to move the engaging members 70 in the direction "β" without the rotational movement, using the seesaw movement.

In addition, even with the configuration accompanying the rotational movement, for example, the pressing members 40 and the engaging members 70 may be disposed to be next to each other, and then helical dents provided on outer wall of the pressing members 40 and the engaging members 70 may be engaged with each other, so as to move the engaging members in the direction "β".

According to the embodiment, the sliding surfaces 62 and 63 are used as the sloped portions and the protrusions 73 are used as engaging portions that correspond to the sloped portions. However, it is not always necessary to use the sliding surfaces and the protrusions. For example, as the sloped portions, protruding portions may be provided and as the engaging portions, concave portions may be provided. The sloped portions and the engaging portions can be any as long they can have the pressing portions 40 and the engaging portions 70 engage each other.

Furthermore, according to the embodiment, the pressing members 40 have the sloped portions 62 and 63 and the engaging members 70 have the engaging portions 73, respectively. Instead, the pressing members 40 can have engaging portions and the engaging members 40 can have sloped portions. Similarly, according to the embodiment, the engaging members 70 have slope portions 84 and the housing 10 has an engaging portion 15, respectively.

Instead, the engaging members 70 can have engaging portions and the housing 10 can have a sloped portion, respectively.

Furthermore, according to the embodiment, an example of using only one terminal attaching/detaching device 1 is shown. However, it is also possible to laterally join a plurality of the devices 1, using the attachment pieces 29 of the side flat portions 24 of the upper covers 25. The illustrated example is mere one of embodiments.

The present invention may be widely applied in devices that attach/detach terminals thereto/therefrom. Therefore, the applicable industrial field of the present invention may not be specifically limited.

The disclosure of Japanese Patent Applications No. 2015-251950, filed on Dec. 24, 2015, is incorporated in the application by reference.

While the present invention has been explained with reference to the specific embodiments of the present invention, the explanation is illustrative and the present invention is limited only by the appended claims.

What is claimed is:

1. A terminal attaching/detaching device for attaching and detaching a terminal, comprising:

a housing for receiving the terminal;

an engaging member configured to move in a first direction toward the terminal inserted in the housing so that the engaging member is engaged with the terminal, said engaging member being configured to move in a second direction away from the terminal so that the engaging member is disengaged from the terminal; and a movable member configured to move in the first direction so that the engaging member moves in the second direction, wherein said engaging member is configured to rotate in a third direction when the movable member moves in the first direction, and said engaging member is configured to rotate in a fourth direction opposite to the third direction when the movable member moves in the second direction.

2. The terminal attaching/detaching device according to claim 1, wherein said engaging member is configured to move in the first direction when the movable member moves in the second direction.

3. The terminal attaching/detaching device according to claim 1, wherein said engaging member is configured to move in the first direction opposite to the second direction.

4. The terminal attaching/detaching device according to claim 1, wherein said movable member and said engaging member are aligned to each other along the first direction.

5. The terminal attaching/detaching device according to claim 1, wherein said engaging member is accommodated in the movable member, and said movable member includes a window so that the engaging member accommodated in the movable member becomes visible.

6. The terminal attaching/detaching device according to claim 1, wherein said housing includes an opening portion for receiving the terminal so that the terminal is inserted into the housing in a direction perpendicular to the first direction.

7. The terminal attaching/detaching device according to claim 1, further comprising an electrical connection mechanism for electrically connecting the terminal to another terminal inserted into the housing.

8. The terminal attaching/detaching device according to claim 1, wherein said movable member includes a pressing portion, and said pressing portion protrudes from the housing so that the pressing portion is pressed from an outside of the housing.

9. The terminal attaching/detaching device according to claim 1, wherein said movable member includes a first sloped portion inclined by an acute angle relative to the first direction, and said engaging member includes a second engaging portion for engaging with the first sloped portion so that the engaging member rotates.

10. The terminal attaching/detaching device according to claim 9, wherein said first engaging portion is formed of a protruding portion protruding outwardly from an outer surface of the engaging member so that the first engaging portion is accommodated in the first sloped portion.

11. The terminal attaching/detaching device according to claim 1, wherein said engaging member includes a second sloped portion inclined by an acute angle relative to the first direction, and said housing includes a second engaging portion for engaging with the second sloped portion so that the engaging member rotates.

12. The terminal attaching/detaching device according to claim 11, wherein said second engaging portion is formed of a protruding portion protruding outwardly from an outer surface of the housing so that the second engaging portion is accommodated in the second sloped portion.

* * * * *